US005269387A

United States Patent [19]

Nance

[11] Patent Number: 5,269,387

[45] Date of Patent: Dec. 14, 1993

[54] INSERT FOR MINE ROOF TOOL BIT

[75] Inventor: Larry S. Nance, Madisonville, Ky.

[73] Assignee: Tungco, Incorporated, Hanson, Ky.

[21] Appl. No.: 842,551

[22] Filed: Feb. 27, 1992

[51] Int. Cl.[5] ..... E21B 10/58

[52] U.S. Cl. ..... 175/420.1; 175/427

[58] Field of Search ..... 175/427, 430, 431, 420.1

[56] References Cited

U.S. PATENT DOCUMENTS

| | | | |
|---|---|---|---|
| 3,163,246 | 12/1964 | Vagins et al. | 175/410 |
| 3,198,270 | 8/1965 | Horvath | 175/410 |
| 3,434,552 | 3/1969 | Bower, Jr. | 175/410 |
| 4,143,723 | 3/1979 | Schmotzer | 175/420.1 |
| 4,268,582 | 5/1981 | Hale et al. | 428/446 |
| 4,314,616 | 2/1982 | Rauckhorst et al. | 175/394 |
| 4,342,368 | 8/1982 | Denman | 175/410 |
| 4,356,873 | 11/1982 | Dziak | 175/410 |
| 4,489,796 | 12/1984 | Sanchez et al. | 175/410 |
| 4,527,638 | 7/1985 | Sanchez et al. | 175/57 |
| 4,696,352 | 9/1987 | Buljan et al. | 175/57 |
| 4,787,464 | 11/1988 | Ojanen | 175/57 |
| 4,984,944 | 1/1991 | Pennington, Jr. et al. | 175/420.1 X |

*Primary Examiner*—William P. Neuder

*Attorney, Agent, or Firm*—Cohn, Powell & Hind

[57] ABSTRACT

This mine roof tool bit insert, formed from a flat elongated body, provides opposed side faces, opposed end faces, a bottom face, opposed top faces and opposed intermediate faces disposed between associated top faces and end faces, the body forming identical halves rotating about a central axis. Each half includes a top cutting edge an intermediate cutting edge and end cutting edge. The top face, intermediate face and end face are planar and are rearwardly inclined to provide a constant relief angle. The intermediate cutting edge is inclined relative to a plane normal of the axis of rotation at an angle greater than that of the top cutting edge. The method of drilling a hole in a mine roof using a bit insert of this character includes positioning the insert, rotating the insert at about 200 to 1000 rpm and applying a thrust of about 1000 to 8000 lbs. to the insert.

20 Claims, 1 Drawing Sheet

INSERT FOR MINE ROOF TOOL BIT

BACKGROUND OF THE INVENTION

This invention relates generally to mine roof tool bit inserts and particularly to an insert having an improved arrangement of cutting edges.

Mine roofs require stabilization to ensure that they will support the load of the roof and effective stabilization can be achieved by means of inserting elongated roof bolts into the roof. The use of such roof bolts require the forming of elongated holes drilled directly into the roof and it is important that the bit inserts which form these holes have effective cutting edges but also have a long wear life.

Typically the bit inserts are made from a flat elongated body formed from identical halves rotatable about a central axis, each half having top and end cutting edges, the top cutting edge being inclined to the axis of rotation and the end cutting edge being generally parallel to the axis of rotation. The top cutting edge and the side cutting edge are usually provided with a relief angle between the cutting, or leading, edge and the trailing edge.

Various cutting edge arrangements have been developed by modifying the geometry of the bit insert to improve the wear resistance. For example, U.S. Pat. No. 4,787,464 discloses a bit insert having a leading (side) face inclined at small angle relative to the axis of rotation and a frontal (top) face having a variable relief angle. U.S. Pat. No. 4,527,638 on the other hand provides a bit insert having a top face with a constant relief angle, but having a radiused corner between the top cutting edge and the end cutting edge. In another reference, U.S. Pat. No. 4,696,352, the bit insert is coated with one or more adherent layers of a refractory coating material to increase wear resistance.

While the above bit inserts may be effective for their intended purpose of increasing wear resistance such improvement is achieved by providing a relatively complex geometry or an expensive coating.

The present improved bit insert provides greater wear resistance without these disadvantages.

SUMMARY OF THE INVENTION

This mine roof tool bit insert provides an improved cutting ability and wear resistance by introducing an additional cutting edge between the top cutting edge and the side cutting edge.

This mine roof tool bit insert includes a flat elongated body providing a plurality of planar faces including opposed side faces, opposed end faces, a bottom face, opposed top faces and opposed intermediate faces disposed between associated top faces and end faces, said body forming two identical halves rotatable about a central axis; each identical half including a top cutting edge defined by a side face and a top face, an intermediate cutting edge defined by said side face and an intermediate face and an end cutting edge defined by said side face and an end face; each identical half including a top trailing edge defined by an opposed side face and said top face, an intermediate trailing edge defined by said opposed side face and said intermediate face and an end trailing edge defined by said opposed side face and said end face; said top face being rearwardly inclined between said cutting edge and trailing edge to define a first relief angle and said intermediate face being rearwardly inclined between said cutting edge and said trailing edge to define a second relief angle; the top cutting edge being inclined at a first angle relative to a plane normal to said axis of rotation and said intermediate cutting edge being inclined at a second angle relative to a plane normal to said axis of rotation, said second angle being greater than said first angle.

It is an important aspect of this invention that the second angle of inclination of the intermediate cutting edge and the horizontal length component thereof are such as to significantly increase the life of the insert.

It is an aspect of this invention that said end face is rearwardly inclined between said cutting edge and said trailing edge to define a third relief angle.

It is another aspect of this invention that said first relief angle is constant.

It is yet another aspect of this invention that said second relief angle is constant.

It is still another aspect of this invention that said third relief angle is constant.

Another aspect of this invention is that said first and second relief angles are equal.

Yet another aspect of this invention is that said first and second relief angles are equal and said third relief angle is less than said first and second relief angles.

It is an aspect of this invention that said first and second relief angles are about eighteen to thirty-five degrees (18°–35°).

Still another aspect of this invention is that said first and second relief angles are about twenty-five degrees (25°).

It is an aspect of this invention that said third relief angle is about seven degrees (7°).

It is another aspect of this invention that said first angle of inclination is about twenty degrees (20°).

It is yet another aspect of this invention that said second angle of inclination is about thirty to sixty degrees (30°–60°).

Another aspect of this invention is that said second angle of inclination is about forty-five degrees (45°).

It is another aspect of this invention that said horizontal length component of the intermediate cutting edge is about five to twenty percent (5%–20%) of the diameter of the insert.

It is still another aspect of this invention that the horizontal length component of the intermediate cutting edge is about ten to fifteen percent (10%–15%) of the diameter of the insert.

It is an aspect of this invention that said second angle of inclination and said horizontal length component cooperate to significantly increase the life of the insert and the penetration rate of said insert.

An aspect of this invention is to provide a method of drilling a hole in a mine roof comprising the steps of positioning a mine tool including a top cutting edge, an end cutting edge, and an intermediate cutting edge, the intermediate cutting edge being inclined at angle relative to a plane normal to the direction of rotation greater than the angle of said top cutting edge; rotating the insert at from about 200 to 1000 rpm and applying a thrust of about 1000 lbs. to 8000 lbs.

This mine roof bit insert is simple and inexpensive to manufacture and results in a significant improvement in the effectiveness of the bit insert in drilling elongated roof bolt holes.

DESCRIPTION OF THE PREFERRED EMBODIMENT

Figure 1:
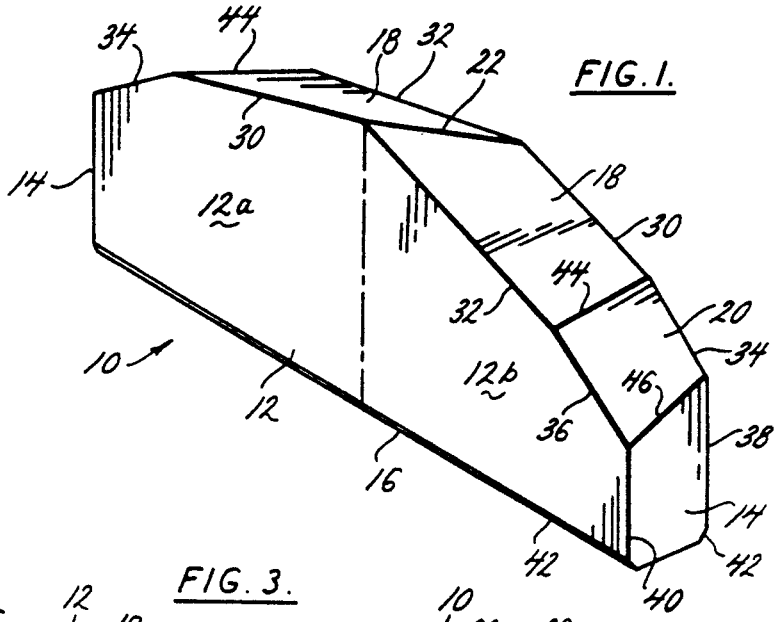
FIG. 1 is a perspective view of the bit insert.
Figure 3:
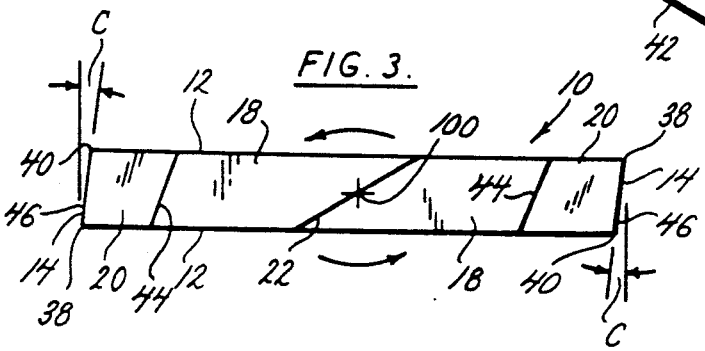
FIG. 3 is a plan view thereof.
Figure 5:
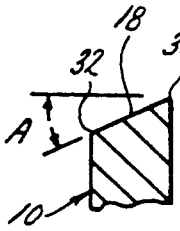
FIG. 5 is a fragmentary cross section view taken on line 5—5 of FIG. 3.
Figure 6:
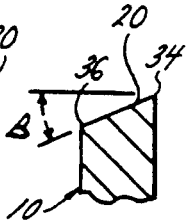
FIG. 6 is a fragmentary cross section view taken on line 6—6 of FIG. 3.

Referring now by reference numerals to the drawing and first to FIG. 1 it will be understood that a mine roof tool drill bit insert is indicated by numeral 10. The insert 10 shown is a relatively flat block formed from material such as cemented carbide and consists of a set of intersecting planar surfaces rotatable about a central axis 100.

More specifically, the insert 10 includes opposed side faces 12, end faces 14, a bottom face 16, opposed top faces 18 and intermediate faces 20. The geometry of the insert 10 provides identical halves rotatable about the central axis 100 and defined by the apex edge 22, dividing the front and rear faces 12 into portions 12*a* and 12*b* defined by vertical lines 23. Because of this structural relationship of parts, identical faces, edges and other parts shown in the drawing are given the same reference numerals.

Figure 2:
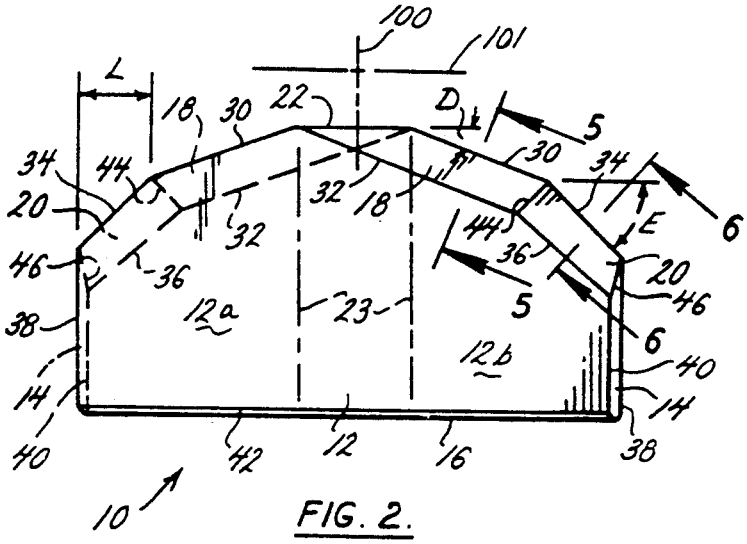
FIG. 2 is an elevational view thereof.
Figure 4:
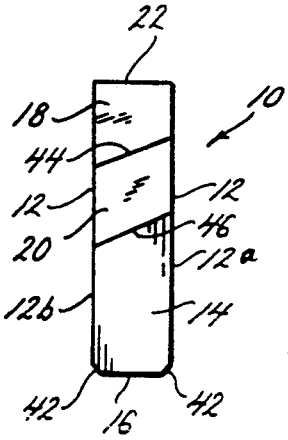
FIG. 4 is an end view thereof.

As shown by the arrows in FIG. 2, the direction of rotation of the insert is counter clockwise. The top, intermediate and end faces 18, 20 and 14, respectively, are inclined rearwardly relative to the direction of rotation to provide relief angles and define leading or cutting edges, and trailing edges. In the embodiment shown the top faces 18 cooperate with face portions 12*a* and 12*b* to define top cutting and trailing edges 30 and 32 respectively having a common first relief angle is indicated by A. The intermediate faces 20 cooperate with side face portions 12*a* and 12*b* to define intermediate cutting and trailing edges 34 and 36 respectively having a common second relief angle indicated by B. The end faces 14 cooperate with side face portions 12*a* and 12*b* to define end cutting and trailing edges 38 and 40 having a common third relief angle indicated by C. The bottom face 16 is normal to the axis of rotation and has chamfered edges 42 between it and the vertical faces 12, chamfered at about forty-five degrees (45°).

The angle of the top face cutting and trailing edges, relative to a plane 101, normal to the axis of rotation, constitutes a first inclined angle indicated by D: the angle of the intermediate face cutting and trailing edges, relative to a plane 101 normal to the axis of rotation, constitutes a second inclined angle greater than said first angle and indicated by angle E, and these faces have a common intersecting edge 44. The end faces 14 are substantially parallel to the axis of rotation and have a common intersecting edge 46 with the intermediate faces 20.

In the embodiment shown the insert angles A–E are as follows: relief angle A and relief angle B, twenty-five degrees (25°); relief angle C, seven degrees (7°); angle of inclination D, twenty degrees (20°); and angle of inclination E forty-five degrees (45°). In the embodiment shown, the distance L, the horizontal length component of the intermediate cutting edge 34, is about ten to fifteen percent (10%–15%) of the nominal diameter of the insert about twelve percent (12%) in the embodiment shown.

The insert has shown great improvement in reducing wear and increasing insert life expectancy in comparative testing against a conventional or standard insert of substantially the same dimensions but without the critically important intermediate faces 20 providing the cutting edges 34 and two cutting points or corners defined by the intersection of the cutting edge 34 with its adjacent top cutting edge 30 and end cutting edge 38 rather than a single cutting point or corner defined by the top and end cutting edges of the conventional insert.

The common angles of the conventional insert (CON.) were substantially the same as those for the improved insert (IMP.). The insert diameters in the test results were likewise substantially the same. The only significant difference in the improved insert (IMP.) as compared with the conventional insert (CON) were the provision, in the improved insert of the intermediate cutting edge having an angle E of about forty-five degrees (45°) and a horizontal length component L of between about ten to fifteen percent (10%–15%) of the nominal insert diameter.

The tests were conducted using conventional and improved inserts to drill holes of various lengths for both 1" and 1⅜" diameter bolts. As is typical, holes for 1" bolts were drilled for the first half of their length using 1-1/32" diameter inserts and for the second half of their length using 1" diameter inserts. Similarly, holes for 1⅜" bolts were drilled for the first half of their length using 1½" diameter inserts and for the second half of their length using 1⅜" diameter inserts. A somewhat larger porportion of the holes, rougly two-thirds, were drilled to accomodate the larger diameter bolts.

Both the conventional and improved bit were formed from the same material namely cemented carbide. The comparison tests were performed to determine reduction in wear and consequent increase in insert life, penetration speed and dust analysis.

The tests for both inserts were performed in rock which was largely shale with some bands of iron pyrite.

In performing method of drilling holes in the mine roof to receive stabilizing bolts the insert was brazed onto the mine roof drilling tool bit in the usual way. The insert was positioned at a suitable drilling speed and a suitable thrust applied to perform the drilling operation. Throughout the tests a drilling speed of about 500–600 rpm, preferably 570 rpm, was maintained with a boom thrust of 3000–5000 lbs. However, wider ranges of drilling speeds and thrust are to be expected under some conditions and the insert could be used with drilling speeds of 200–1000 rpm and thrusts of 1000–8000 lbs.

A vacuum of eighteen inches of mercury (18 in. Hg.) was maintained to remove chips and dust from the holes to facilitate drilling and accurate readings.

EXAMPLE I

The first set of two tests were performed to determine the life of the conventional and improved inserts before being discarded because of dullness due to wear. The tests were performed under actual working conditions over a three week period. The conventional insert (CON.) and the improved insert (IMP.) were given daily to an experienced roof pinner operator who recorded the number and depth of each hole drilled before the insert became dull to arrive at a cumulative depth drilled by each bit as shown in Table I. Values recorded were totalled and averaged for the two tests.

With respect to increased insert life due to reduction in wear, dullness was determined by the operator by observation of a slowdown in the penetration rate and by visual inspection of the cutting edges. Inserts that were ready to be discarded, both conventional and improved, showed an average of about one thirty-second to one sixteen of an inch (1/32" to 1/16") of wear on the outer corner of the conventional insert and distributed along the cutting edge of the improved insert, respectively. Continued use of the insert beyond this degree of dullness or practical point of usefulness exhibited a rapid deterioration from the heat of friction leading to facturing and destruction of the tool. It will be understood that an experienced operator is able to determine the point at which a tool ceases to be effective and must be discarded.

TABLE I

| Insert Life - Cumulative Distance Drilled in Inches | | | |
|---|---|---|---|
| Test | CON. | IMP. | Improvement % (IMP./CON.) × 100 |
| 1 | 468 | 2412 | 515% |
| 2 | 360 | 1440 | 400% |
| Average | 414 | 1926 | 465% |

These results indicate dramatically the superiority, with respect to increased life, of the improved insert of the present invention having intermediate cutting edges between the top and end cutting edges. The tests demonstrated that the average life of the improved insert was over four times that of the conventional insert.

EXAMPLE II

The second set of two tests were performed under the same conditions as the first set to determine the rate of penetration of the conventional inserts and improved inserts using about the same proportion of bolt sizes as in the previous tests. Dust samples were also taken during these tests. The penetration test results are shown in Table II. The dust analysis results are shown in Table III.

With respect to penetration rate, time studies were made of the time taken for the operator to drill and pin the roof. Holes were drilled to a predetermined total depth of about six feet (6'). A digital stop watch was used to record the time in seconds required to drill to a predetermined depth in inches. The length of the hole divided by the time required to drill the hole resulted in the recorded rate in inches per second (in/sec). Values recorded were totalled and averages were calculated from two tests.

TABLE II

| Penetration Rate - Inches Per Second | | | |
|---|---|---|---|
| Test | CON. | IMP. | Improvement % (IMP. − CON.)/CON. × 100 |
| 1 | 2.6 | 3.0 | 15% |
| 2 | 2.3 | 2.9 | 26% |
| Average | 2.45 | 2.95 | 20% |

These results demonstrate that the penetration rate of the improved insert of the invention is actually improved by an average of twenty percent of that of the conventional insert indicating that the increased life of the improved insert is not achieved at the expense of the penetration rate.

TABLE III

| | Dust Samples - grams | | | |
|---|---|---|---|---|
| | CON. | | IMP. | |
| Mesh size | weight | percent | weight | percent |
| 25 and up | 11 | 23 | 16 | 34 |
| 40–25 | 16 | 34 | 13 | 28 |
| 80–40 | 14 | 30 | 15 | 32 |
| Below 80 | 6 | 13 | 3 | 6 |

The dust analysis shows 11% increase in mesh size 25 and up and a 50% decrease in dust below 80 mesh in the improved insert of the invention. These results illustrate that the improved life (TABLE I) and the improved rate of penetration (TABLE II) of the insert of the present invention are due to increased efficiency in the cutting and chipping of the rock which is demonstrated by the existence of more and larger pieces of rock breaking away as opposed to being crushed and ground finer. The improved cutting edge action resulting from the provision of the intermediate cutting edge also appears to reduce heat build-up in the improved insert of the invention thereby reducing wear and fracturing of the insert.

It will be understood that while the provision of substantial intermediate cutting edges between the top cutting edge and the end cutting edge are critical to the success of the improved insert, the actual angle of inclination E of the intermediate cutting edge and the horizontal length component L of said cutting edge can vary from the values in the embodiment shown and still produce excellent results substantially improving the life of the insert. For example, although the second angle of inclination E of the embodiment shown is about forty-five degrees (45°), it is expected that angles of from about thirty degrees to sixty degrees (30°–60°) will greatly improve the life of the insert. Likewise, although the horizontal length component L of the cutting edge in the embodiment shown is about ten to fifteen percent (10%–15%) of the diameter of the bit, with an average of about twelve percent (12%), it is expected that length components of between about five to twenty percent (5%–20%) will also greatly improve the life of the insert. It is intended therefore that the angle of inclination E and the horizontal length component L thereof be selected to cooperate to significantly increase the life of the insert. As will also be understood, the selected angles E and length L may vary with different roof material.

Similarly, while the relief angles A and B were selected as about twenty-five degrees (25°) for the embodiment shown a range of relief angle from about eighteen to thirty-five degrees (18°–35°) would be reasonable.

The tests demonstrated that the diameter of the inserts to which to invention is applicable include 1", 1-1/32", 1⅜" and 1½".

Having described the invention in detail, those skilled in the art will appreciate that modifications may be made without departing from the spirit. Therefore it is not intended that the scope of the invention be limited to the specific embodiments illustrated and described. Rather, it is intended that the scope of this invention be determined by the appended claims and their equivalents.

I claim as my invention:

1. A mine roof tool bit insert comprising:

(a) a flat elongated body providing a plurality of planar faces including opposed side faces, opposed end faces, a bottom face, opposed top faces and opposed intermediate faces disposed between associated top faces and end faces, said body forming two identical halves rotatable about a central axis, (b) each identical half including a top cutting edge defined by a side face and a top face, an intermediate cutting edge defined by said side face and an intermediate face and an end cutting edge defined by said side face and an end face, (c) each identical half including a top trailing edge defined by an opposed side face and said top face, an intermediate trailing edge defined by said opposed side face and said intermediate face and an end trailing edge defined by said opposed side face and said end face, (d) said top face being rearwardly inclined between said cutting edge and trailing edge to define a first relief angle and said intermediate face being rearwardly inclined between said cutting edge and said trailing edge to define a second relief angle, (e) the top cutting edge being inclined at a first angle relative to a plane normal to said axis of rotation and said intermediate cutting edge being inclined at a second angle relative to a plane normal to said axis of rotation, said second angle being greater than said first angle.

2. A mine roof tool bit insert as defined in claim 1, in which:

(f) said end face is rearwardly inclined between said cutting edge and said trailing edge to define a third relief angle.

3. A mine roof bit insert as defined in claim 1, in which:

(f) said first relief angle is constant.

4. A mine roof bit insert as defined in claim 1, in which:

(f) said second relief angle is constant.

5. A mine roof bit insert as defined in claim 2, in which:

(g) said third relief angle is constant.

6. A mine roof bit insert as defined in claim 1, in which:

(f) said first and second relief angles are equal.

7. A mine roof bit insert as defined in claim 6, in which:

(g) said first and second relief angles are about eighteen to thirty-five degrees (18°-35°).

8. A mine roof bit insert as defined in claim 6, in which:

(h) said first and second relief angles are about twenty-five degrees (25°).

9. A mine roof bit insert as defined in claim 2, in which:

(g) said first and second relief angles are equal and said third relief angle is less than said first and second relief angles.

10. A mine roof bit insert as defined in claim 9, in which:

(i) said third relief angle is about seven degrees (7°).

11. A mine roof bit insert as defined in claim 1, in which:

(f) said first angle of inclination is about twenty degrees (20°).

12. A mine roof bit insert as defined in claim 1, in which:

(f) said second angle of inclination is about thirty to sixty degrees (30°-60°).

13. A mine roof bit insert as defined in claim 1, in which:

(f) said second angle of inclination is about forty-five degrees (45°).

14. A mine roof bit insert as defined in claim 1, in which:

(f) the horizontal length component of the intermediate cutting edge is about five to twenty percent (5%-20%) of the diameter of the insert.

15. A mine roof bit insert as defined in claim 1, in which:

(f) the horizontal length component of the intermediate cutting edge is about ten to fifteen percent (10%-15%) of the diameter of the insert.

16. A mine roof tool bit insert comprising:

(a) a flat elongated body providing a plurality of planar faces including opposed side faces, opposed end faces, a bottom face, opposed top faces and opposed intermediate faces disposed between associated top faces and end faces, said body forming two identical halves rotatable about a central axis, (b) each identical half including a top cutting edge defined by a side face and a top face, an intermediate cutting edge defined by said side face and an intermediate face and an end cutting edge defined by said side face and an end face, (c) each identical half including a top trailing edge defined by an opposed side face and said top face, an intermediate trailing edge defined by said opposed side face and said intermediate face and an end trailing edge defined by said opposed side face and said end face, (d) said top face being rearwardly inclined between said cutting edge and trailing edge to define a first relief angle and said intermediate face being rearwardly inclined between said cutting edge and said trailing edge to define a second relief angle, (e) the top cutting edge being inclined at a first angle relative to a plane normal to said axis of rotation and said intermediate cutting edge being inclined at a second angle relative to a plane normal to said axis of rotation, said second angle being greater than said first angle, (f) the second angle of inclination of the intermediate cutting edge and the horizontal length component thereof being such as to significantly increase the life of the insert.

17. A mine roof tool bit insert as defined in claim 16, in which:

(g) said first and second relief angles are about eighteen to thirty-five degrees (18°-35°).

18. A mine roof tool bit insert as defined in claim 16, in which:

(g) said second angle of inclination is about thirty to sixty degrees (30°-60°).

(h) said horizontal length component is about five to twenty percent (5%-20%) of the diameter of the insert,

19. A mine roof tool bit insert as defined in claim 16, in which:

(g) said second angle of inclination is about forty-five degrees (45°), and (h) said horizontal length component is about ten to fifteen percent (10%-15%) of the diameter of insert.

20. A method of drilling a hole in a mine roof comprising the steps of:

(a) positioning a mine roof tool including a bit insert comprising:

a flat elongated body providing a plurality of planar faces including opposed side faces, opposed end faces, a bottom face, opposed top faces and opposed intermediate faces disposed between associated top faces and end faces, said body forming two identical halves rotatable about a central axis, each identical half including a top cutting edge defined by a side face and a top face, an intermediate cutting edge defined by said side face and an intermediate face and an end cutting edge defined by said side face and an end face, each identical half including a top trailing edge defined by an opposed side face and said top face, an intermediate trailing edge defined by said opposed side face and said intermediate face and an end trailing edge defined by said opposed side face and said end face, said top face being rearwardly inclined between said cutting edge and trailing edge to define a first relief angle and said intermediate face being rearwardly inclined between said cutting edge and said trailing edge to define a second relief angle, the top cutting edge being inclined at a first angle relative to a plane normal to said axis of rotation and said intermediate cutting edge being inclined at a second angle relative to a plane normal to said axis of rotation, said second angle being greater than said first angle, the second angle of inclination of the intermediate cutting edge and the horizontal length component thereof being such as to significantly increase the life of the insert, (b) rotating the insert at about 200–1000 rpm, and (c) applying a thrust of about 1000 lbs. to 8000 lbs. to said insert.

* * * * *